United States Patent [19]

Innes et al.

[11] Patent Number: 4,646,671

[45] Date of Patent: Mar. 3, 1987

[54] AIRFLOW ENHANCEMENT FOR SAILBOAT HEADSAILS

[76] Inventors: James G. Innes, 2244-216th St., Langley, B.C., Canada, V3A 7R2; Ferdinand Hofer, 8611 #2 Road, Richmond, B.C., Canada, V7C 3M4

[21] Appl. No.: 734,957

[22] Filed: May 16, 1985

Related U.S. Application Data

[63] Continuation-in-part of Ser. No. 584,124, Feb. 27, 1984, abandoned.

[51] Int. Cl.[4] ..... B63H 9/08

[52] U.S. Cl. ..... 114/103; 114/39

[58] Field of Search ..... 114/102, 103, 39.1, 114/104, 105, 90

[56] References Cited

U.S. PATENT DOCUMENTS

| | | | |
|---|---|---|---|
| 3,800,728 | 4/1974 | Dowling | 114/102 |
| 3,802,373 | 4/1974 | Lagerqust | 114/102 |
| 3,851,609 | 12/1974 | Stearn | 114/105 |
| 3,948,200 | 4/1976 | Hood et al. | 114/105 |
| 4,196,687 | 4/1980 | Newick | 114/106 |
| 4,211,179 | 7/1980 | Saunders | 114/105 |
| 4,369,726 | 1/1983 | Mader | 114/39.1 |

FOREIGN PATENT DOCUMENTS

| | | | |
|---|---|---|---|
| 838999 | 5/1968 | Canada | 114/103 |

*Primary Examiner*—Sherman D. Basinger
*Assistant Examiner*—Edwin L. Swinehart
*Attorney, Agent, or Firm*—Jensen & Puntigam

[57] ABSTRACT

An apparatus for improving the flow of air past the headsail (5) of a sailboat including an airfoil (41) which is oval-shaped in cross-section, the leading edge of the sail being secured in a groove (45) along one side thereof. A portion (37 or 39) of the curved surface of the airfoil (41) extends into the wind, with the surface (37 or 39) curving toward the inner side of the sail, forming a wide leading edge for the sail. The airfoil (41) may be rotated about the leading edge of the headsail as necessary, depending on the direction of the boat relative to the wind.

4 Claims, 11 Drawing Figures

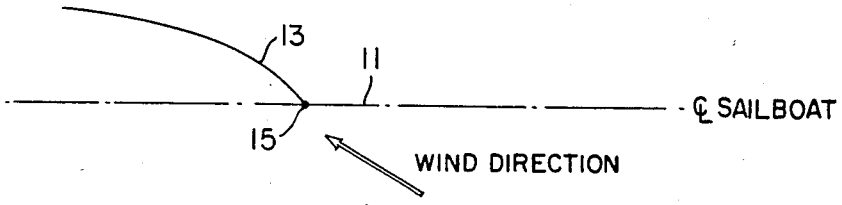
FIG. 1
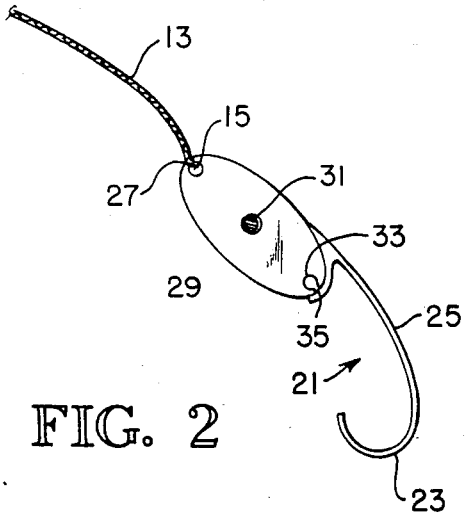
FIG. 2
FIG. 3
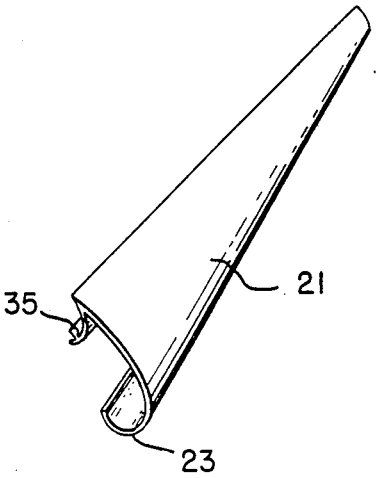
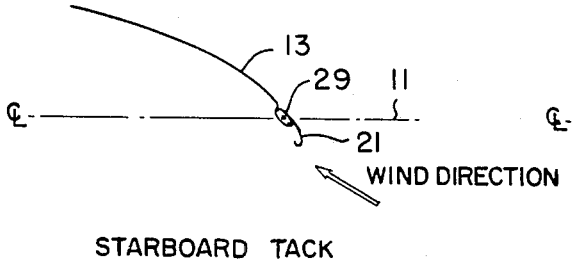
FIG. 4A
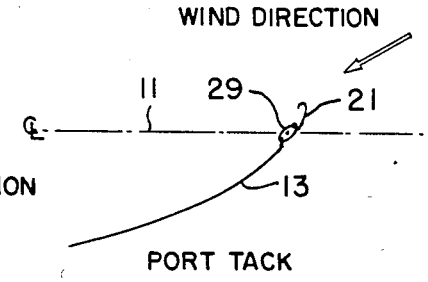
FIG. 4B

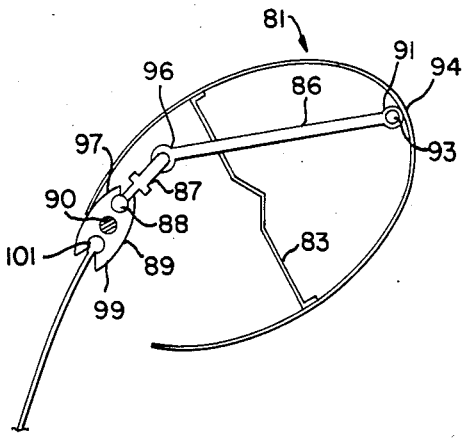
FIG. 7
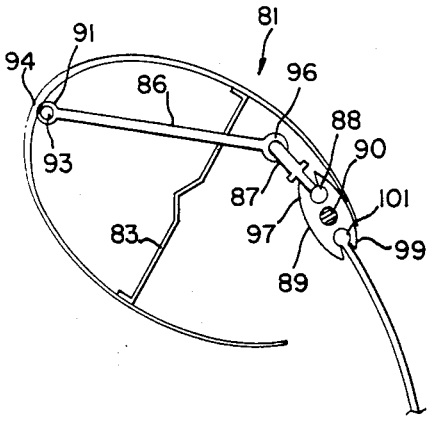
FIG. 8
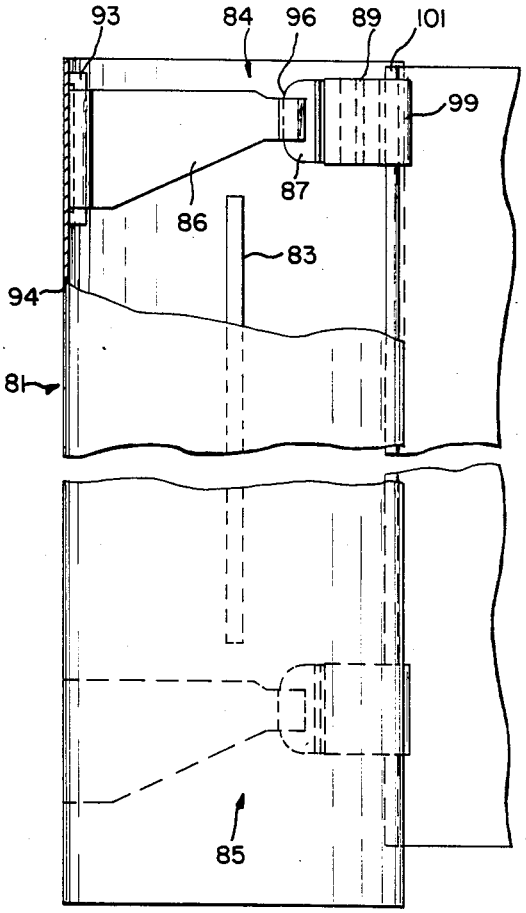
FIG. 9
FIG. 10
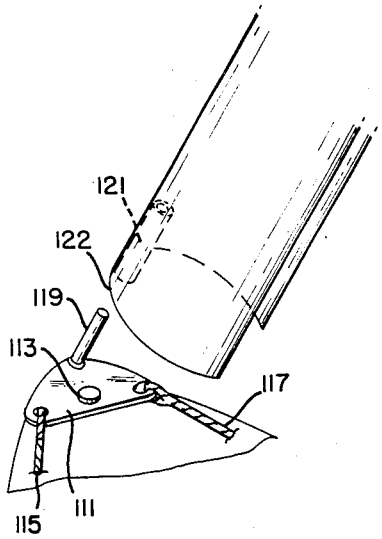

AIRFLOW ENHANCEMENT FOR SAILBOAT HEADSAILS

DESCRIPTION

This application is a continuation-in-part of patent application Ser. No. 584,124, filed Feb. 27, 1984, now abandoned in the names of James Innes and Ferdinand Hofer.

TECHNICAL FIELD

This invention relates generally to the sailboat art, and more specifically concerns a sailboat accessory which is used at the leading edge of a sail, such as a headsail, to enhance the airflow across the sail.

BACKGROUND OF THE INVENTION

A significant amount of sailboat technology has been directed toward increasing the speed of a sailboat under various operating conditions. Toward that end, the configuration of the sailboat hull, as well as the size, configuration, and relative placement of the sails and accessory equipment have all been the subject of a significant amount of design effort and experimentation. The increasing number and significance of various sailboat races is an additional incentive to increase sailboat speed.

However, relatively little effort or experimentation has been directed toward enhancing the flow of air past the sails although there are devices commercially available which are of assistance in making maximum use of the available wind, i.e. to permit sailing as close to the wind as possible. An example of such a device is the strips or tufts of material which are positioned at spaced locations over the area of the sail, which provide an indication of the optimum position of the sail relative to the direction of the wind when they are extending outwardly from the surface of the sail. Still other devices are used to accurately determine wind direction, so that the sails can be controlled accordingly, as well as numerous devices to assist in the convenient control of the position of the sails.

The inventors, however, have experimented with enhancing the airflow past the sails. In studying the airflow from an aerodynamic viewpoint, they have discovered that sailboats are typically hindered in making maximum use of the available wind because a sail per se is in essence a high speed airfoil section, as shown in FIG. 1. A high speed section is characterized by a narrow leading edge, and a sail inherently has a narrow leading edge, as does the typically correspondingly narrow forestay which extends the length of the sail and secures the leading edge of the sail to the boat.

Such a narrow leading edge is often disadvantageous for a sail, however, as it significantly limits the angle over which the sail can perform without stalling when the boat is sailing close to the wind. Turbulent water or other operating variables will frequently induce a stall and turbulent airflow across the sail will also result in a loss of boat speed.

A narrow leading edge was discovered by the inventors to have an additional disadvantage in that a narrow leading edge is suited for high speeds, beyond that of sailboats, which results again in the maximum effect of existing wind not being obtained. In summary, the inventors have found that a narrow leading edge is rarely, if ever, desirable for a sail.

SUMMARY OF THE INVENTION

Accordingly, the inventors further discovered that the use of a "low-speed" airfoil section, at the leading edge of the sail would significantly enhance the airflow past the sail. A low-speed section is conventionally characterized aerodynamically by a thick or relatively wide leading edge. The present invention is thus an apparatus for improving the airflow past a sail, including an airfoil means which is positioned in the vicinity of the leading edge of the sail, a portion of which airfoil means is presented into the wind. The airfoil portion acts as a thick or relatively wide leading edge for the sail as compared to the leading edge of the sail itself, resulting in an enhancement of the flow of air past the sail.

BRIEF DESCRIPTION OF THE DRAWINGS

FIG. 1 is a section view of a conventional sail.

FIG. 2 is a section view of a portion of a conventional sail and forestay fairing, shown also in section the airflow enhancement device of the present invention.

FIG. 3 is a perspective view of the airflow enhancement device of FIG. 2.

FIGS. 4*a* and 4*b* are section views of a sail and the airflow enhancement device of FIGS. 2 and 3, when the sail is in a starboard tack and a port tack, respectively.

FIG. 7 is a horizontal cross-section view of a further embodiment of the present invention showing a sail in one position.

FIG. 8 is a horizontal cross-section view of the embodiment of FIG. 7, showing the sail in a second position.

FIG. 9 is a partially cutaway elevational view of the embodiment of FIGS. 7 and 8.

FIG. 10 is a schematic view showing the apparatus for moving the embodiment of FIGS. 7–9.

BEST MODE FOR CARRYING OUT THE INVENTION

Figure 5:
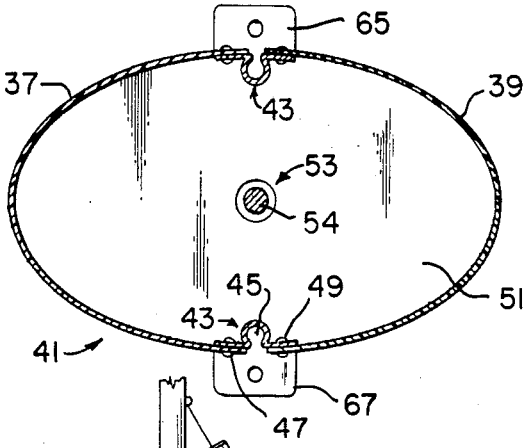
FIG. 5 is a section view of another embodiment of the airflow enhancement device of the present invention.

FIG. 1 is a section view of the sail configuration of the prior art, in relation to a particular wind direction as shown and the centerline 11 of the boat on which the sail is mounted. Optimally, the sail 13 is positioned as close to the wind as possible, i.e. the sail 13 is substantially parallel with the direction of the wind. However, as pointed out above, the chances of a stall or turbulent airflow condition over the sail, which result in a reduction in boat speed, significantly increase as the sail is moved closer and closer to the wind direction. The inherent high-speed shape of the sail, including sharp leading edge 15, is a substantial limiting factor on the performance of the sailboat.

FIGS. 2 and 3 show one embodiment of the present invention, which is an airfoil device, in the form of a nose airfoil section 21, which is secured to the leading edge 15 of the sail 13. Airfoil section 21 is a relatively thin section of rigid material, one portion 23 of which is curved, substantially in the form of a semi-circle or half-oval, the other portion 25 being substantially straight, a continuation of one side of the curved portion, so that section 21 as a whole resembles a hook or the letter "J".

The curved portion 23 may take various configurations, such as are already known in the airfoil art. The partial oval configuration, however, has been shown to produce good results. The straight portion 25 may also vary in configuration from that shown and described above, as it serves to function as a reasonably continuous intermediate surface between the sail 13 and curved portion 25 of the airfoil section 21. In operation, airfoil section 21 provides a thick or wide leading edge for the sail, so that the leading edge has a relatively large camber compared to the leading edge of the sail itself, resulting in the sail acting like a low-speed section aerodynamically, thus achieving increased use of the wind and in turn increased boat speed.

In the embodiment shown, airfoil section 21 extends along substantially the entire length of the leading edge of the sail, but is arranged in sections instead of one piece. The length of the sections may vary to allow for sag of the forestay, but in the embodiment shown, the sections are approximately 5 feet long, with the sections being made from rigid material such as alumiunum or plastic, approximately 1/64th inch thick. The thickness of the material will vary, however, depending on the strength of the material. Again in the embodiment shown, the total width of the material comprising the section is 12 inches, while the section is approximately 9 inches from side to side.

FIG. 2 shows a means for securing airfoil section 21 to the leading edge of sail 13. The sail 13 is shown in FIG. 2 with its leading edge 15 secured in a slot 27 alone one side of a fairing 29. The fairing 29 has a central opening within which extends the conventional forestay line 31. The fairing 29 in the embodiment shown extends substantially the length of the sail 13, and is a conventional arrangement in the sailboat art.

Along the other side of the fairing 29 is another slot 33, into which is positioned the free end of an attachment element 35. The other end of element 35 is secured to the straight portion 25 of the airfoil section 21 near the free end thereof. The arrangement of attachment element 35 is such that when the free end of attachment element 35 is positioned in slot 33, straight portion 25 of airfoil 21 is substantially a continuation of the sail 13. Airfoil section 21 thus has a fixed orientation relative to fairing 29 and hence sail 13.

The arrangement as shown in FIG. 2 will result in a significant enhancement of the airflow past the sail to which it is secured, since the sail effectively has a thick leading edge, because of the large camber of the airfoil section compared to the leading edge of the sail per se. This results in an increase in the speed of the boat, and the boat can sail closer to the wind without a risk of stalling the sail. The sailing speed can be further optimized by using the conventional strip or tuft attachments to the sails, as discussed above. Thus, with the invention shown in FIGS. 2 and 3, the leading edge configuration of the sail is substantially changed so that the sail acts like a low-speed airfoil section.

However, a disadvantage to the configuration of the airflow enhancement device of FIGS. 2 and 3 is that the device must be reversed for starboard and port tacks, respectively, as illustrated in FIGS. 4A and 4B. In FIG. 4A, for a starboard tack, the orientation of the sail and the airfoil section 21 is similar to that shown in FIG. 2. However, when the boat is on a port tack, the orientation of the airfoil section must be reversed to provide the desired airfoil results relative to the wind direction. Thus, when the boat is changing from a starboard tack to a port tack, the sections of the airfoil must be removed and then reversed, and vice versa. The reversing process may be acceptable when the boat is cruising, with few tack changes, but is time-consuming and inconvenient when many tack changes are necessary, such as may occur in a typical racing situation.

To solve the tack change problem, the inventors first made an airfoil section which was curved and positioned centrally about the forestay, and arranged so that it was free to rotate about the forestay according to the wind direction. Ropes could also be used to control the orientation of such an airfoil. Such an arrangement does not require reversal of the airfoil for starboard and port tacking but is probably somewhat less efficient as an airfoil in operation than the arrangement shown in FIGS. 2 and 3.

FIG. 5 shows a further embodiment for which reversal of the airfoil section is not necessary. The embodiment of FIG. 5 comprises two curved sections 37 and 39 which are secured together along their respective opposing side edges to form a single oval or egg-shaped nose airfoil section 41. The two curved sections 37, 39 are joined by 2 sections of slotted track 43—43, each of which has a central slot 45 bounded by two flange portions 47 and 49. The longitudinal edges of the curved sections 37, 39 are secured to the mating flange portions of the slotted tracks 43—43. This results in a closed member with two exposed slots extending down the opposite outer sides thereof. The configuration of the curve of sections 37 and 39 may vary, in accordance with standard low-speed airfoil configurations. An oval shaped configuration is shown to FIG. 5, and this has proven to provide satisfactory results.

Each longitudinal section or portion of the airfoil of FIG. 5 includes one or more interior ribs 51 which extend perpendicular to the sections 37 and 39 over the interior area of airfoil. The ribs 51 provide internal stiffening for the airfoil sections. The ribs 51 are made of lightweight stiff material and are typically positioned every 10–12 inches, depending on the strength of the airfoil section material and the rib material. In the center of rib 51 is an opening in which is positioned a bushing 53. In operation, the forestay line 54 extends through bushing 53. The leading edge of the sail is secured in the slot 45 along one selected side of the airfoil, so that the sail is essentially tangent to the surface of the airfoil. The portion of the airfoil forward of the point where the sail is secured to curved and provides a wide leading edge for the sail and hence an enhancement or increase in airflow over the sail.

The airfoil section 41 is rotatable about the forestay 54, so that when the sail is changed from a starboard to a port tack, the airfoil is rotated 180 degrees so that the opposite curved section is presented to the wind. Thus, the correct orientation of the sail and the airfoil may be maintained by simply rotating the airfoil 180 degrees about the forestay which effectively reverses the position of the airfoil, so that the airfoil remains a continuation of the sail surface, with the curved portion extending to the inside of the sail.

The bottom one of the plurality of airfoil sections comprising the airfoil is provided with two tabs 65, 67 which extend outwardly from the lower end of the slotted tracks, on opposite sides of the airfoil. There are openings in the tabs 65, 67 to accommodate ropes or similar control lines, which may be manipulated so as to conveniently rotate the entire airfoil. The airfoil may be in sections which are connected together or are overlapped, so that they operate as one unit, or conceivably, the airfoil could be one continuous piece. Also, if the airfoil section is sufficiently strong, the forestay itself could be completely eliminated.

Figure 6:
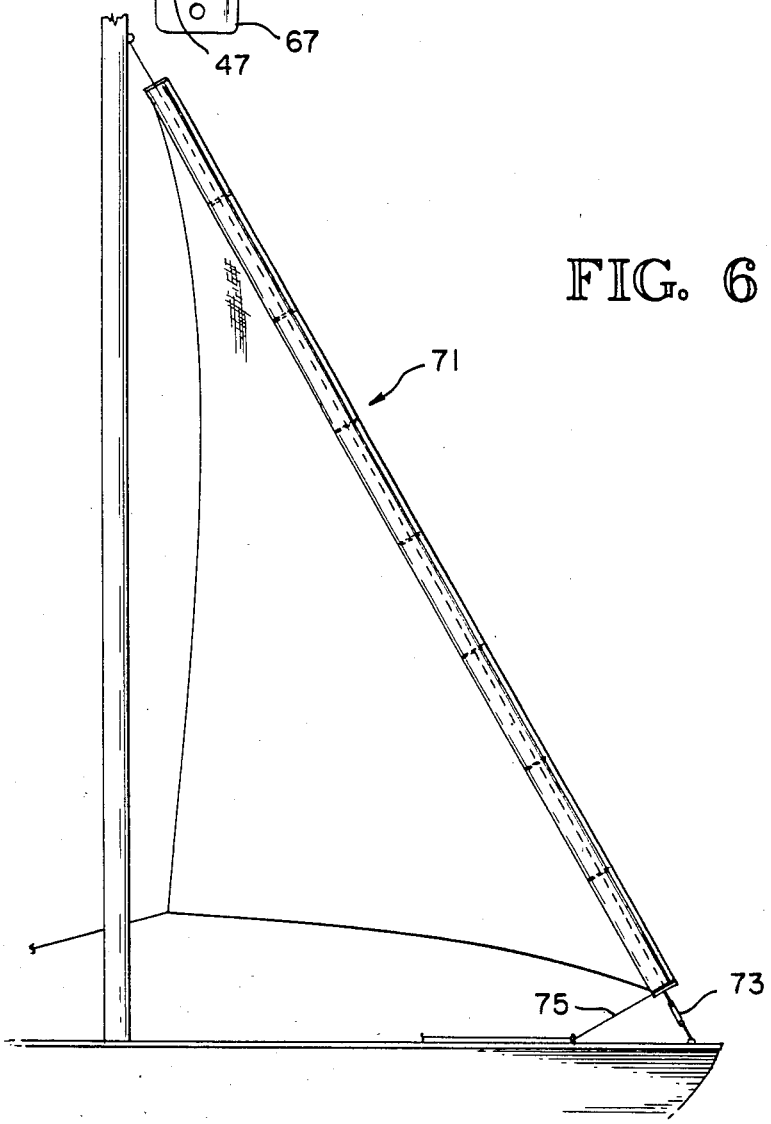
FIG. 6 is an elevation view showing a plurality of sections of the embodiment of FIG. 5 connected together and placed along the leading edge of a sail.

FIG. 6 shows the airfoil system 71 of FIG. 5 on a boat. The airfoil system forms a thick or wide leading edge for the sail, because of its large camber, along the forestay line 73. Control lines 75 extending from the bottom one of the airfoil sections are used to rotate the airfoil 71 during tacking, to maintain the proper airfoil orientation relative to the sail, as explained above.

FIGS. 7–10 show another embodiment of the present invention. Those figures show a single airfoil section 81 which is approximately 36 inches long. In cross-section, the airfoil section 81 is substantially oval, but open at one end of the minor axis. Extending for substantially the length of each section, with the exception of several inches at the top and bottom, respectively, is an internal stiffening rib 83, which in the embodiment shown is approximately $3\frac{1}{2}$ inches across. The stiffening rib 83 provides structural rigidity for the airfoil section 81. The sections could of course be of different lengths and/or could be extruded, which could eliminate the requirement of the stiffening rib.

In the vicinity of both the top and bottom of each section 81 are hinge elements 84 and 85, of which hinge element 84 is exemplary. Hinge 85 element comprises a hinge arm 86 and a sail slug element 87 which swingably connects the hinge arm 86 to a conventional headstay foil 89. The forward end 91 of hinge arm 86 is rotatably connected to a pivot pin 93 which is secured to the airfoil section 81 at the leading edge 94 of the foil, parallel to the longitudinal dimension of the section 81. In the embodiment shown, pivot pin 93 is approximately 2 inches long. The forward end 91 of hinge arm 86 is slightly less than 2 inches high at this point; it then narrows from forward end 91 to rear end 96, where it is approximately $\frac{1}{2}$ inch high. In the embodiment shown, hinge arm 86 is approximately $\frac{1}{8}$th inch thick and $3\frac{1}{2}$ inches long.

The rear end 96 of hinge arm 86 is rotatably secured to slug 87, which in the embodiment shown is approximately 1 inch long and 1 inch high. The rear end 88 of slug 87 fits rotatably into one end 97 of the headstay foil 89.

In the other end 99 of the headstay 89 is the leading edge of a sail, such as headsail 101. The headstay extends along a conventional forestay line 90, which runs from the top of the mast (not shown) to the deck of the boat through the headstay.

The airfoil section 81 is thus free to rotate about the headstay 89 and hence the leading edge of the sail, which are essentially fixed in position. FIGS. 7 and 8 show the two possible positions of the airfoil 81 relative to the wind. To move between the two positions, the airfoil is rotated so as to change the position of the leading edge of the airfoil relative to the sail. The airfoil 81 is rotatable because of the rotatable connection between the front end 91 of hinge arm 86 and pivot pin 93, the rear end 96 of hinge arm 86 and the sail slug 87 and the one end 97 of headstay 89 and slug 87.

The actual rotation of the airfoil may be accomplished in several ways, but one example is shown in FIG. 10. The apparatus shown is a bell crank, and includes a plate 111 pivoted about a pin 113. Control lines 115 and 117 are secured to the opposite sides of the bell crank plate. An upstanding finger 119 from plate 111 fits into, and is secured by some means to, a receiving tube 121 which is secured near the bottom edge 122 of the lowermost airfoil section. Pulling on one or other of the control lines rotates the finger 119 and hence airfoil sections between the positions shown in FIGS. 7 and 8, i.e. for a port or starboard tack or position of the sail. A plurality of individual airfoil sections can be secured together by tabs (not shown) which extend off the ends of each section, or by any other conventional means, so that all of the airfoil sections along the forestay can be moved as one unit, as described above for other embodiments. Alternatively, one airfoil section could extend for the entire desired length of the device.

Thus, an apparatus has been described which is configured and positioned in relation to a sail to provide a thick or wide leading edge for the sail relative to the wind, which has the effect of the sail acting like a low-speed airfoil section. This arrangement enhances the airflow past the sail, increasing boat speed.

Although a preferred embodiment of the invention has been disclosed herein for illustration, it should be understood that various changes, modifications and substitutions may be incorporated in such embodiment without departing from the spirit of the invention, as defined by the claims which follow.

We claim:

1. An apparatus for improving the airflow past a headsail, wherein the leading edge of the headsail, and a headstay associated therewith, act aerodynamically like a high speed airfoil, the apparatus comprising:

substantially rigid airfoil means adapted to be added along the leading edge of the headstay, wherein the headstay extends along the leading edge of the headsail and connects the headsail to a forestay line which extends from the mast to the deck of the boat, said airfoil means being rotatably connected to the headstay and not immediately connected to the headsail so that said airfoil means is not under tension from the sail when the sail is under load, such that the angle of said airfoil means relative to the sail can be readily changed, even when the sail is under load, said airfoil means presenting a relatively wide leading edge for the headsail compared to the leading edge of the headsail and the leading edge of the headstay, said airfoil means thus acting aerodynamically like a low speed airfoil along the heading edge of the headsail, enhancing the flow of air past the headsail.

2. An apparatus of claim 1, wherein the headsail includes an inner side and an outer side, wherein said airfoil means is rotatable relative to the leading edge of the headsail such that the surface of the airfoil means in operation is always essentially tangent to the surface of the headsail, and wherein the portion of the airfoil which extends into the wind curves away from the leading edge of the headsail toward the inner side of the headsail.

3. An apparatus of claim 2, including means for securing said airfoil means in a selected position.

4. An apparatus of claim 2, wherein said airfoil means comprises a plurality of airfoil sections, connected together and extending substantially the length of the leading edge of the headsail.

* * * * *